US010443959B2

(12) United States Patent
Streeter et al.

(10) Patent No.: US 10,443,959 B2
(45) Date of Patent: Oct. 15, 2019

(54) INTEGRAL HEAT EXCHANGER MANIFOLD GUIDE VANES AND SUPPORTS

(71) Applicant: Hamilton Sundstrand Corporation, Charlotte, NC (US)

(72) Inventors: James Streeter, Torrington, CT (US); Michael Zager, Windsor, CT (US); Ryan Matthew Kelley, Bloomfield, CT (US); Gabriel Ruiz, Granby, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 15/923,561

(22) Filed: Mar. 16, 2018

(65) Prior Publication Data

US 2019/0285365 A1 Sep. 19, 2019

(51) Int. Cl.

| | |
|---|---|
| ***F28F 9/02*** | (2006.01) |
| ***F28F 3/02*** | (2006.01) |
| ***F28D 9/00*** | (2006.01) |

(52) U.S. Cl.

CPC ..... *F28F 9/026* (2013.01); *F28D 9/0093* (2013.01); *F28F 3/02* (2013.01); *F28F 9/0268* (2013.01)

(58) Field of Classification Search

CPC ..... F28F 209/0285; F28F 209/029; F28F 9/0202; F28F 9/09265

USPC ..... 165/174, 175

See application file for complete search history.

(56) References Cited

U.S. PATENT DOCUMENTS 4,681,155 A * 7/1987 Kredo ..... F28F 3/025 138/163

6,896,043 B2 * 5/2005 Dunn ..... F28D 9/0062 165/165

8,726,976 B2 5/2014 Schrader et al.

9,557,121 B2 1/2017 Park et al.

2003/0111210 A1 * 6/2003 Tsujita ..... F28D 7/1653 165/51

2008/0190592 A1 * 8/2008 Bruck ..... F01N 3/02 165/159

(Continued)

FOREIGN PATENT DOCUMENTS

EP 3410054 A1 5/2018

OTHER PUBLICATIONS

Extended European Search Report dated Jul. 15, 2019, received for corresponding European Application No. 19163199.3.

*Primary Examiner* — Allen J Flanigan

(74) *Attorney, Agent, or Firm* — Kinney & Lange, P.A.

(57) ABSTRACT

An embodiment of a heat exchanger according to the disclosure includes a core configured to receive and place a plurality of mediums in at least one heat exchange relationship, and a first manifold connected to and in fluid communication with the core at a first manifold/core interface. The first manifold includes a first end distal from the core with at least one port adapted to receive or discharge a first medium of the plurality of mediums, and a second end joined to the core at the first manifold/core interface adapted to transfer the first medium to or from a plurality of first heat exchange passages in the core. A plurality of first guide vanes in the manifold defining individual layers for the first medium, and a plurality of second guide vanes divide ones of the individual layers into a plurality of first discrete manifold flow passages extending at least part of a distance from the first end to the second end of the first manifold.

19 Claims, 5 Drawing Sheets

(56) References Cited

U.S. PATENT DOCUMENTS

| | | | | |
|---|---|---|---|---|
| 2014/0000841 | A1* | 1/2014 | Baker | F25B 29/00 165/59 |
| 2017/0146305 | A1* | 5/2017 | Kuczek | B23P 15/26 |
| 2017/0205145 | A1 | 7/2017 | Manteiga et al. | |
| 2017/0211894 | A1 | 7/2017 | Schwalm | |
| 2018/0238276 | A1* | 8/2018 | Jeong | F02M 26/32 |

* cited by examiner

INTEGRAL HEAT EXCHANGER MANIFOLD GUIDE VANES AND SUPPORTS

BACKGROUND

The disclosure is directed generally to heat exchangers, and more specifically to manifolds for heat exchangers.

Heat exchangers that operate at elevated temperatures, such as those in modern aircraft engines, often have short service lives due to high steady state and cyclic thermal stresses. Inlet and exit manifolds are typically pressure vessels that are welded or bolted at only the exterior perimeter to a heat exchanger core or matrix. Pressure requirements dictate the thickness of these manifolds, usually resulting in a relatively thick header attached to a thin core matrix. This mismatch in thickness and mass, while acceptable for pressure loads, conflicts with the goal of avoiding geometric, stiffness, mass and material discontinuities to limit thermal stress.

Further, air flow distribution from conventional open manifolds can be very non-uniform, depending on core pressure drop, flow velocity, and orientation and size of the ducts. The core is therefore not fully utilized, and in some cases the hot circuit and cold circuit flows can largely miss each other.

SUMMARY

An embodiment of a heat exchanger according to the disclosure includes a core configured to receive and place a plurality of mediums in at least one heat exchange relationship, and a first manifold connected to and in fluid communication with the core at a first manifold/core interface. The first manifold includes a first end distal from the core with at least one port adapted to receive or discharge a first medium of the plurality of mediums, and a second end joined to the core at the first manifold/core interface adapted to transfer the first medium to or from a plurality of first heat exchange passages in the core. A plurality of first guide vanes in the manifold defining individual layers for the first medium, and a plurality of second guide vanes divide ones of the individual layers into a plurality of first discrete manifold flow passages extending at least part of a distance from the first end to the second end of the first manifold.

An embodiment of a method according to the disclosure includes forming a core for a heat exchanger and additively manufacturing a first manifold for the heat exchanger. A housing is additively built for the first manifold. Within the housing, a plurality of first guide vanes is additively built, defining individual layers for the first medium. A plurality of additively built second guide vanes divide ones of the individual layers into a plurality of discrete first manifold flow passages.

DETAILED DESCRIPTION

Figure 1:
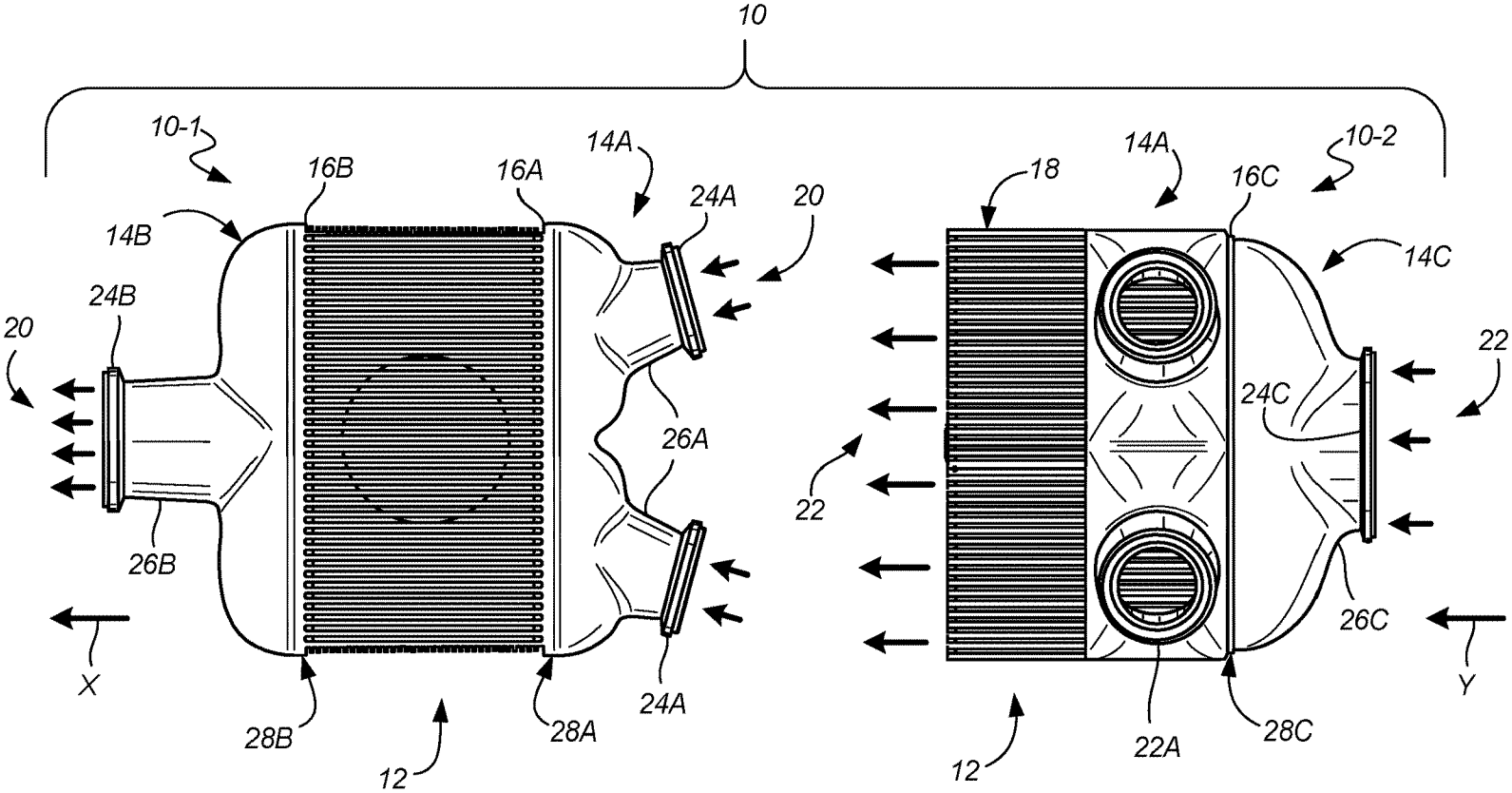
FIG. 1 is an example heat exchanger.

FIG. 1 shows an example heat exchanger assembly 10, with first and second views 10-1 and 10-2. At its most basic, assembly 10 includes core 12 and one or more manifolds 14A, 14B, 14C meeting at respective manifold/core interfaces 16A, 16B, 16C. Assembly 10 can also be mounted at one or more mount locations 18, supporting heat exchanger assembly 10 in a larger system (not shown).

Core 12 generally receives and places a plurality of mediums (here 20, 22) in at least one heat exchange relationship with one another. As is generally known in the art, core 12 can include structures, walls, tubes, etc. to facilitate a cross-flow, counter-flow, micro-channel, or other hybrid heat exchange relationship. In this particular non-limiting example, heat exchanger assembly 10 comprises a plate-and-fin heat exchanger, with specific details to follow. Heat exchanger assembly 10 can also be any other type of heat exchanger that generally utilizes alternating layers (e.g., micro-channel heat exchangers).

First manifold 14A, second manifold 14B, and third manifold 14C are connected to and in fluid communication with core 12 at respective first, second, and third manifold/core interfaces 16A, 16B, 16C. One or more manifolds (here, first manifold 14A) include a first end 26A distal from core 12 with at least one port 24A adapted to receive (or discharge) a first medium of the plurality of mediums (e.g., medium 20 or 22). Second end 28A of first manifold 14A is joined to core 12 at first manifold/core interface 16A, and is adapted to transfer first medium 20 either to or from a plurality of first heat exchange passages 140 (shown in FIG. 4) in core 12. Similarly, second manifold 14B includes a first end 26B and a second end 28B, the first end distal from core 12 with at least one port 24B adapted to discharge (or receive) the first medium 20. Third manifold 14C includes first end 26C and second end 28C for medium 22 to enter core 12 via port 24C. Thus, via manifolds 14A, 14B, 14C, core 12 receives first medium 20 flowing in first direction X and second medium 22 of the plurality of mediums flowing in second direction Y at a nonzero angle relative to first direction X. These directions X and Y may vary from layer to layer within core 12, for example in a counterflow heat exchanger core.

Figure 2:
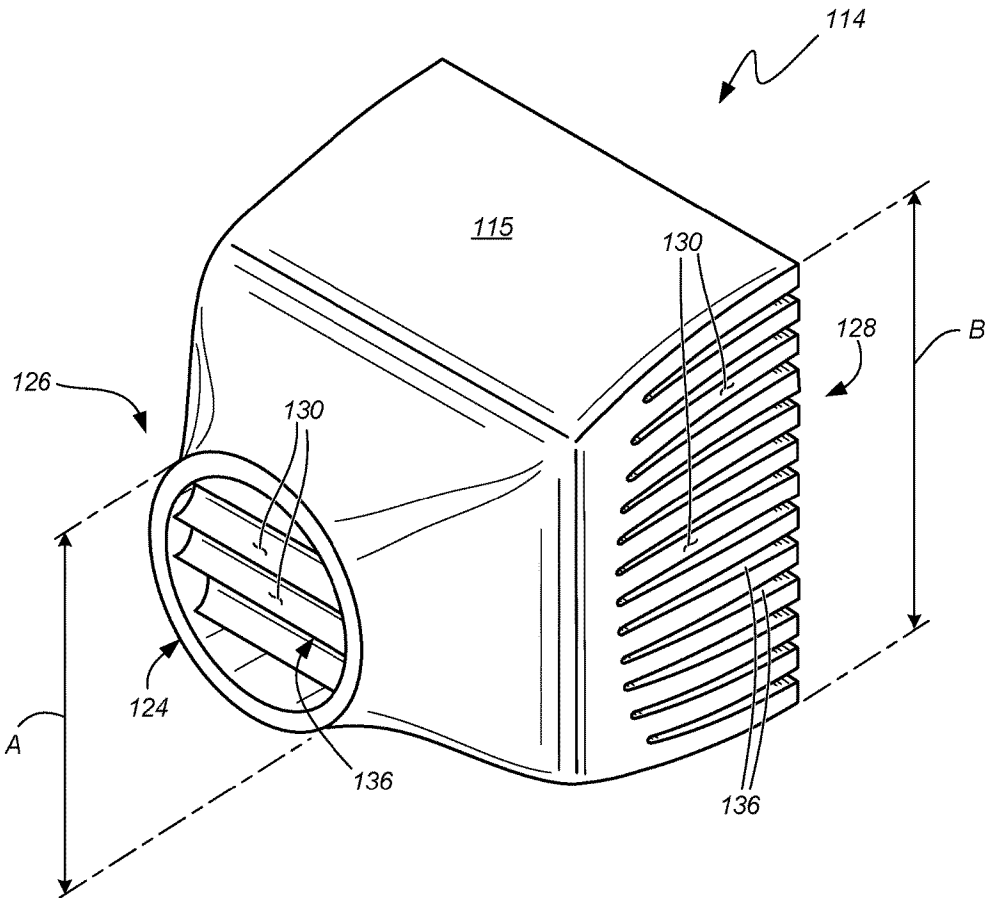
FIG. 2 is a manifold for a heat exchanger.
Figure 3:
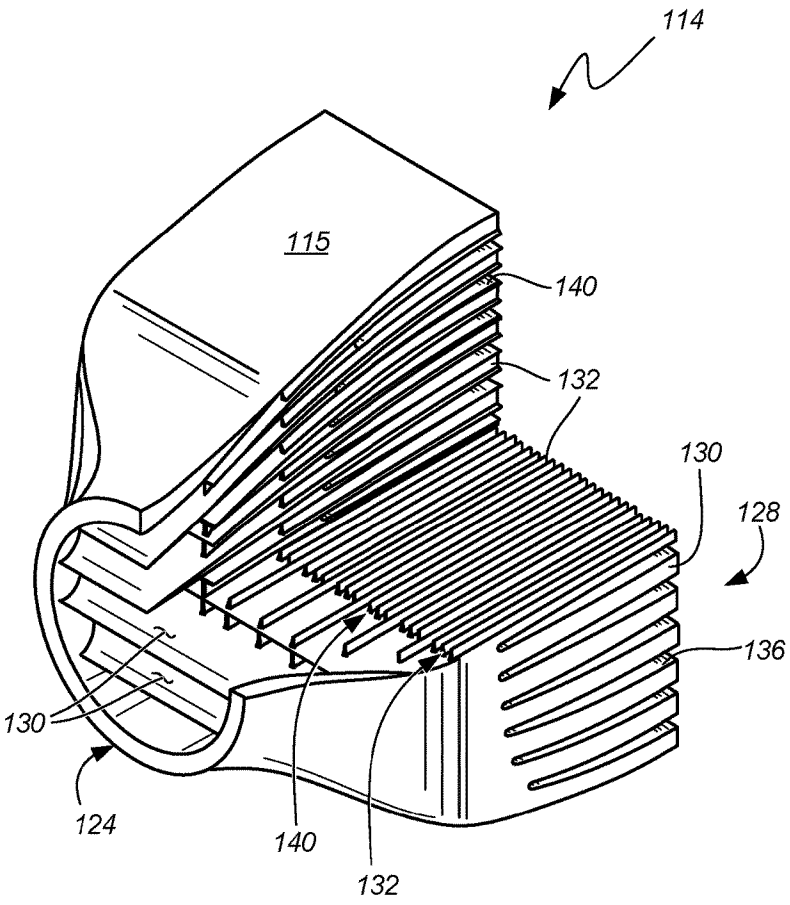
FIG. 3 is a quarter section of the manifold shown in FIG. 2.

FIG. 2 is a perspective view of an example manifold 114, and FIG. 3 is a quarter-sectional view of the example manifold of FIG. 2. FIGS. 2 and 3 generally show housing 115, port(s) 124, first and second ends 126, 128, first/horizontal guide vanes 130, and second/vertical guide vanes 132.

As used herein, the terms "vertical" and "horizontal" are relative to a standard upright orientation of the heat exchanger. They do not necessarily imply indicate these guide vanes have specific orientations relative to gravity, nor does it necessarily require, unless specifically stated in a claim, that the vanes are exactly perpendicular to one another at some or all points.

A plurality of first/horizontal guide vanes 130 define individual layers 136 for at least one medium (e.g., medium 20 and/or 22 in FIG. 1). Together with vanes 130, a plurality of second/vertical guide vanes 132, formed at a nonzero angle to first/horizontal guide vanes 130, can divide ones of the individual layers 136 into a plurality of first discrete manifold flow passages 140 extending at least part of a distance from the first end 126 to the second end 128 of manifold 114, or vice versa. Direction of flow would depend on whether manifold 114 is serving as an intake manifold or an exhaust manifold.

Individual layers 136 of manifold 114 can be formed as gradual transitions (i.e., continuous, homogeneous transitions) from first end 126 to second end 128 to reduce or eliminate discontinuities that in otherwise conventional designs can cause high stress to the heat exchanger core (not shown in FIGS. 2 and 3), which can lead to an abbreviated service life. Rather, in the present design, the plurality of first/horizontal vanes 130 and thus individual layers 136 are cantilevered and flexible to allow for elastic deformation from media flowing through the manifold passages. As shown, a first end 126 can include an opening or port 124 of size A (sized for coupling to a duct, pipe, or the like to receive the first medium 120) that is smaller than a size B of second end 128 at a manifold/core interface (e.g., 16A, 16B, 16C in FIG. 1). Size A can be a diameter of port 124. Size B can be a height of an opening at second end 128.

Figure 4:
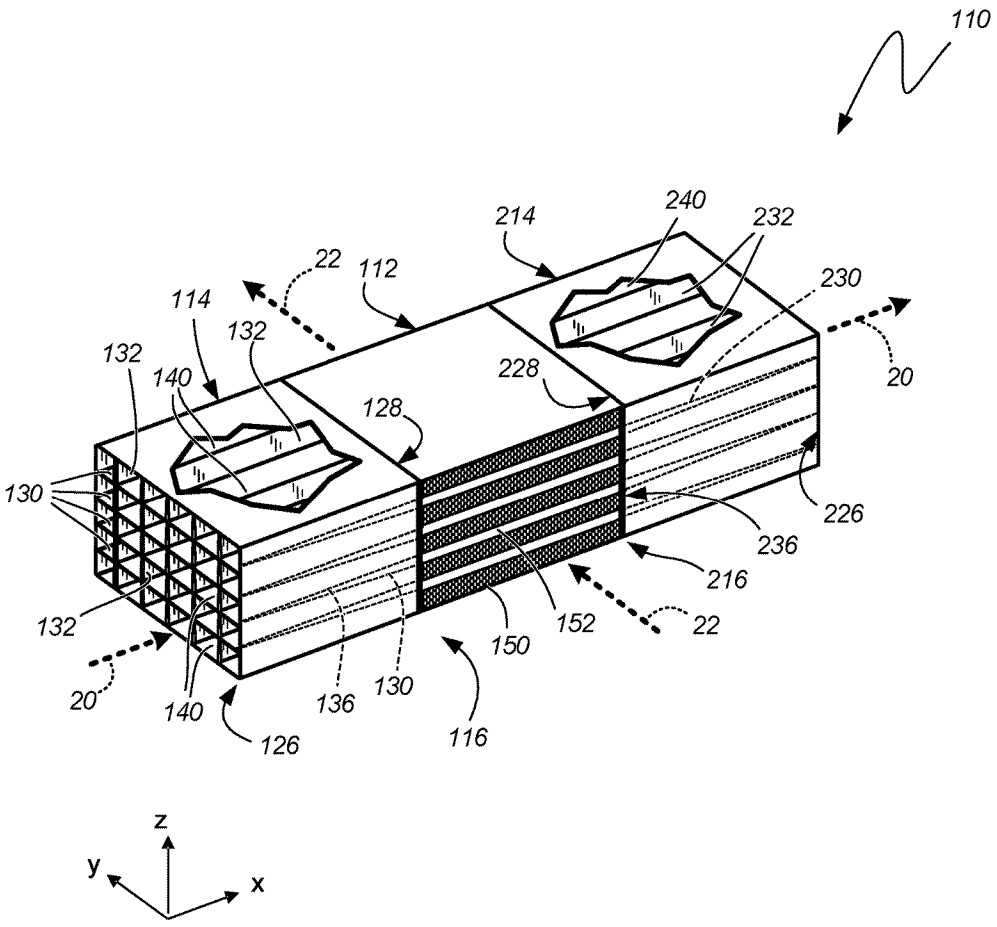
FIG. 4 shows an example interface between manifolds and a core.

FIG. 4 shows a partial schematic of heat exchange assembly 110 including core 112 with first (inlet) manifold 114 and second (outlet) manifold 214 in communication therewith. As in prior examples, first manifold 114 includes one or more ports (omitted for clarity) at first distal end 126 for receiving first medium 20. First manifold 114 can be connected to and in fluid communication with core 112 via first (inlet) manifold/core interface 216 at second manifold end 128. Note in FIG. 4 that a second, potentially similar manifold 214 can be connected to and in fluid communication with core 112 at a second manifold/core interface 216. Second (outlet) manifold 214 includes first end 226 distal from core 112 with at least one port (omitted for clarity) adapted to receive or discharge first medium 20.

With regard to FIG. 4, housings, ports, and other outer structures are omitted. Thus it can be seen that both manifolds 114, 214 have respective first/horizontal vanes 130, 230 and second/vertical vanes 132, 232 extending at least part of a distance from the first end of each manifold to the second end at the manifold/core interface. These vanes in turn define individual layers 136 and discrete manifold flow passages 140 in first/inlet manifold 114, as well as individual layers 236 and discrete manifold flow passages 240 in second/outlet manifold 214.

At least some individual layers 136 or discrete flow passages 140 in inlet manifold 114 are in direct fluid communication with one or more of the first heat exchange passages 150 in crossflow core 112. Similarly, at least some individual layers 236 or discrete flow passages 240 in second/outlet manifold 214 are in direct fluid communication with one or more of the first heat exchange passages 150 to discharge first medium 20 from crossflow core 112 after undergoing heat exchange with second medium 22 (flowing through second heat exchange passages 152.

Second manifold 214 can be, as here, an exhaust manifold for first medium 20. Additionally or alternatively, assembly 110 can include an intake manifold for the second medium (omitted from FIG. 4 for clarity, but see e.g., manifold 16C in FIG. 1), or any other design for facilitating flow of one or more mediums into and/or out of heat exchange core 112.

Figure 5:
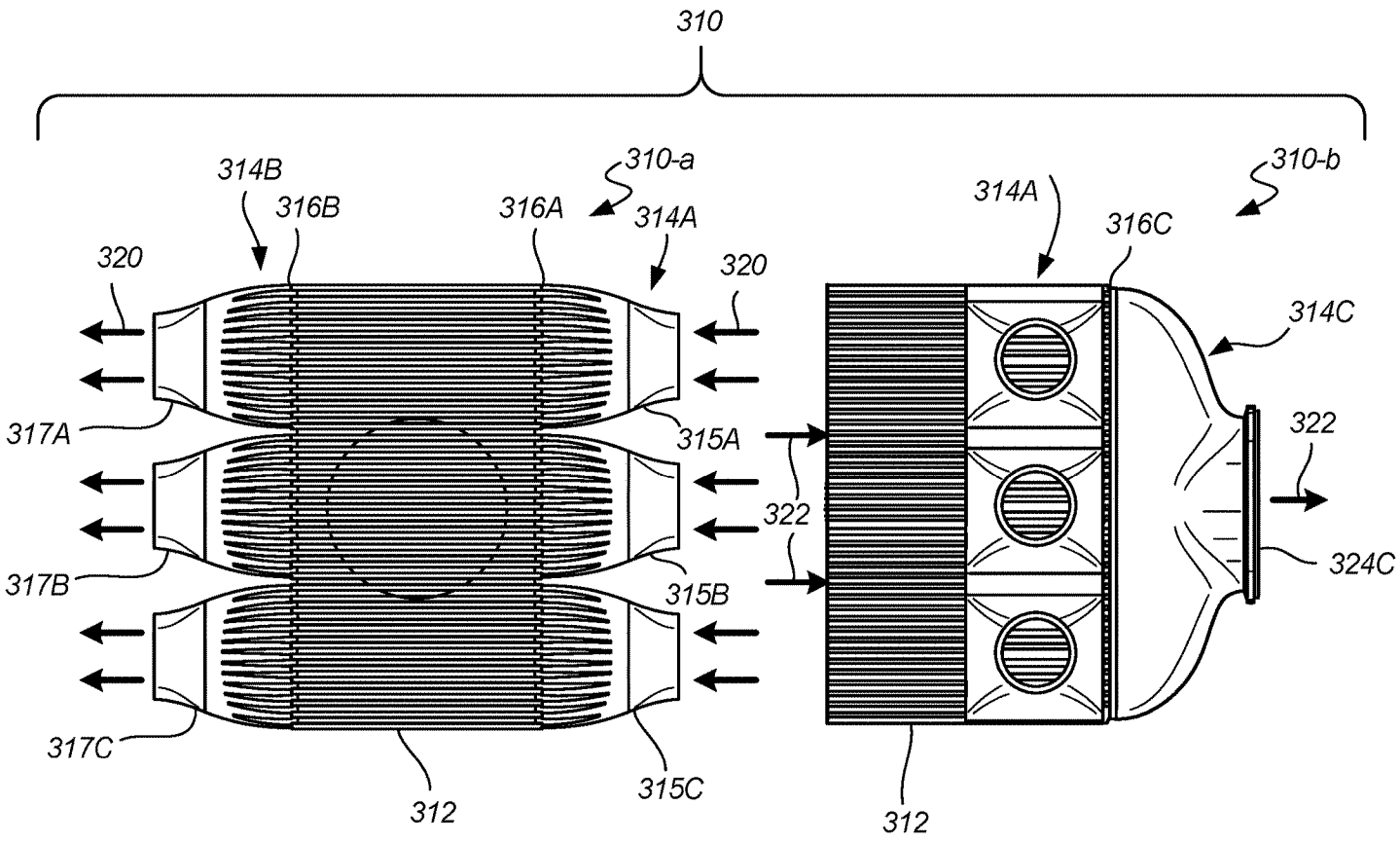
FIG. 5 shows a manifold/heat exchanger with multiple sub-units

FIG. 5 shows another example embodiment of heat exchanger assembly 310. shown in two different perspectives 310-*a* and 310-*b*. Heat exchanger assembly 310 can be a plate and fin heat exchanger as shown, or a micro-channel heat exchanger, that receives a plurality of mediums, such as first medium 320 and second medium 322. The heat exchanger 310 can include core 312, first manifold 314A, second manifold 314B, and third manifold 314C. One or more of the manifolds include individual layers that provide gradual transitions (i.e., continuous, homogeneous transitions) for receiving and/or exhausting the first and second mediums 320, 322 while reducing or eliminating discontinuities that cause high stress to the heat exchanger 310 proximate to manifold/core interfaces 316A, 316B, 316C. Each sub-unit can be independently sized and/or configured to provide gradual transitions distinct from other sub-units.

Different from earlier example embodiments, first manifold 314A comprises a plurality of sub-units 315A, 315B, 315C, each of which is independent from one another. In certain embodiments, each of the plurality of sub-units receives a specified portion, (equal parts or otherwise) of the flow of the first medium. This can be, for example, to optimize or equalize flow of first medium 320 into most or all passages in core 312 in order to maximize opportunity for heat transfer with second medium 322. Inlet flows into a single manifold unit may be uneven due to various reasons, such as upstream thermal and/or pressure gradients in the flow circuit, as well as multiple directional changes immediately upstream of the heat exchanger which could otherwise cause concentration of the medium in one area of the inlet. In other words, flow in conventional headers follows the path of least resistance and may not provide a uniform distribution through the core, resulting in an underperforming unit or one that is oversized and heavier than necessary.

Similarly, second manifold 314B can include a plurality of second sub-units (sub-manifolds), such as sub-units 317A, 317B, 317C, each of which can be independent of the other(s). Note that while three sub-units are shown in FIG. 5 for each of the first manifold 314A and second manifold 314B, this embodiment is not limiting (as the heat exchanger can be expanded to fit more or less sub-units). Alternatively, the sub-manifolds in one or both manifolds 314A, 314B can be connected to one another, eliminating discontinuity between the sub-manifolds.

As shown, third manifold 314C receives second medium via port 324C. Additionally or alternatively, first and/or second manifolds 314A, 314B, each with corresponding sub-units, can be configured so that a first sub-unit receives first medium 320 and at least one other sub-unit in one or both manifolds 314A, 314B receives part of second medium 322. This can be helpful, for example, for certain counterflow or other heat exchanger core geometries where two mediums enter along the same or adjacent sides of the unit so that the flows do not interact within the manifold.

Sizing the individual manifold flow passages and/or via sizing, orientation, and/or spacing of first and second vanes in certain parts of one or more manifolds, including one or more sub-units, increases the resistance to flow in these locations of the manifold where the medium would otherwise tend to accumulate. This in turn balances the pressure drop throughout the manifold in order to more uniformly distribute flow into the core.

Embodiments of heat exchangers described herein can leverage additive manufacturing or any other manufacturing method or methods (e.g., casting) that allows one to construct continuous, homogeneous transitions between the core and one or more manifolds. Additive manufacturing is also useful in building and tailoring second/vertical guide vanes within the manifolds. As the horizontal guide vanes reduce discontinuities in material properties and thermal expansion between the manifold and the core, vertical guide vanes provide stiffness and support to withstand the pressure of medium(s) flowing through the manifold (where welds or bolted flanges are required in conventional heat exchangers).

With that, a method includes forming a core for a heat exchanger and additively manufacturing a first manifold for the heat exchanger. Making the first manifold includes additively building a housing for the first manifold. Within the housing, a plurality of first/horizontal guide vanes are additively built, defining individual layers for the first medium. A plurality of second/vertical guide vanes are additively built, dividing ones of the individual layers into a plurality of discrete first manifold flow passages.

The core is adapted to receive a first medium of the plurality of mediums flowing in a first direction and a second medium of the plurality of mediums flowing in a second direction at any non-zero angle relative to the first direction. In some embodiments, this includes a plate and fin heat exchanger core or a micro-channel heat exchanger core.

In certain embodiments, additive manufacturing of at least the first manifold allows aligning individual layers or discrete flow passages in the manifold such that at least some are in direct communication with one or more of the first heat exchange passages in the core. Additionally and/or alternatively, this can include providing gradual transitions for the first medium from the first end to the second end of the first manifold to reduce or eliminate discontinuities at the first manifold/core interface that cause stress relative to the heat exchanger core.

In certain embodiments, a second manifold for the heat exchanger can also be additively manufactured Like the first manifold, a housing for the second manifold is additively built, and within the housing for the second manifold, one can additively build a plurality of first/horizontal guide vanes defining individual layers for the first medium, as well as a plurality of second/vertical guide vanes dividing ones of the individual layers into a plurality of discrete second manifold flow passages.

In certain embodiments, one or both of the additive manufacturing steps can also include dividing the first and/or second manifold into a plurality of sub-units, each of which is independent from one another. As noted in particular with respect to FIG. 5, sub-units can be helpful to optimize flow into the core. Also, for example, certain counter-flow or other heat exchanger core geometries can utilize manifold sub-units where two mediums enter along the same or adjacent sides of the unit so that the different mediums only interact in the core and do not interact within the manifold.

Discussion of Possible Embodiments

The following are non-exclusive descriptions of possible embodiments of the present invention.

An embodiment of a heat exchanger according to the disclosure includes a core that receives and places a plurality of mediums in at least one heat exchange relationship, and a first manifold connected to and in fluid communication with the core at a first manifold/core interface. The first manifold includes a first end distal from the core with at least one port adapted to receive or discharge a first medium of the plurality of mediums, and a second end joined to the core at the first manifold/core interface adapted to transfer the first medium to or from a plurality of first heat exchange passages in the core. A plurality of first guide vanes in the manifold defining individual layers for the first medium, and a plurality of second guide vanes divide ones of the individual layers into a plurality of first discrete manifold flow passages extending at least part of a distance from the first end to the second end of the first manifold.

The heat exchanger of the preceding paragraph can optionally include, additionally and/or alternatively, any one or more of the following features, configurations and/or additional components:

A heat exchanger according to an exemplary embodiment of this disclosure, among other possible things includes a core that receives and places a plurality of mediums in at least one heat exchange relationship; and a first manifold connected to and in fluid communication with the core at a first manifold/core interface, the first manifold comprising: a first end distal from the core with at least one port adapted to receive or discharge a first medium of the plurality of mediums; a second end joined to the core at the first manifold/core interface adapted to transfer the first medium to or from a plurality of first heat exchange passages in the core; a plurality of first guide vanes defining individual layers for the first medium; and a plurality of second guide vanes dividing ones of the individual layers into a plurality of first discrete manifold flow passages extending at least part of a distance from the first end to the second end of the first manifold.

A further embodiment of the foregoing heat exchanger, wherein the heat exchanger comprises a plate-and-fin heat exchanger or a micro-channel heat exchanger.

A further embodiment of any of the foregoing heat exchangers, wherein at least some of the individual layers or discrete flow passages in the manifold are in direct fluid communication with one or more of the first heat exchange passages in the core.

A further embodiment of any of the foregoing heat exchangers, wherein the core receives the first medium of the plurality of mediums flowing in a first direction and a second medium of the plurality of mediums flowing in a second direction at a nonzero angle relative to the first direction.

A further embodiment of any of the foregoing heat exchangers, wherein the plurality of individual layers are cantilevered and flexible.

A further embodiment of any of the foregoing heat exchangers, further comprising: a second manifold connected to and in fluid communication with the core at a second manifold/core interface, the second manifold comprising: a first end distal from the core with at least one port adapted to receive or discharge a second medium of the plurality of mediums; and a second end joined to the core at the second manifold/core interface adapted to transfer the first medium to or from a plurality of second heat exchange passages in the core.

A further embodiment of any of the foregoing heat exchangers, wherein the second manifold further comprises a plurality of first guide vanes defining individual layers for the second medium, and a plurality of second guide vanes dividing ones of the individual layers into a plurality of second discrete manifold flow passages extending at least part of a distance from the first end to the second manifold/core interface.

A further embodiment of any of the foregoing heat exchangers, wherein the first manifold comprises a plurality of sub-units, each of which is independent from one another.

A further embodiment of any of the foregoing heat exchangers, wherein each of the plurality of sub-units receives a specified portion of the flow of the first medium.

A further embodiment of any of the foregoing heat exchangers, wherein a first sub-unit of the plurality of sub-units receives the first medium and at least one other sub-unit of the plurality of sub-units receives a second medium of the plurality of mediums.

An embodiment of a method according to the disclosure includes forming a core for a heat exchanger and additively manufacturing a first manifold for the heat exchanger. A housing is additively built for the first manifold. Within the housing, a plurality of first guide vanes is additively built, defining individual layers for the first medium. A plurality of additively built second guide vanes divide ones of the individual layers into a plurality of discrete first manifold flow passages.

The method of the preceding paragraph can optionally include, additionally and/or alternatively, any one or more of the following steps, features, configurations and/or additional components:

A method according to an exemplary embodiment of this disclosure, among other possible things includes forming a core for a heat exchanger; additively manufacturing a first manifold for the heat exchanger, the method comprising: additively building a housing for the first manifold; within the housing, additively building a plurality of first guide vanes defining individual layers for the first medium, and additively building a plurality of second guide vanes dividing ones of the individual layers into a plurality of discrete first manifold flow passages.

A further embodiment of the foregoing method, wherein the heat exchanger core comprises a plate and fin heat exchanger core or a micro-channel heat exchanger core.

A further embodiment of any of the foregoing methods, further comprising aligning individual layers or discrete flow passages in the manifold such that at least some are in direct communication with one or more of the first heat exchange passages in the core.

A further embodiment of any of the foregoing methods, wherein the core receives the first medium of the plurality of mediums flowing in a first direction and a second medium of the plurality of mediums flowing in a second direction at any angle relative to the first direction.

A further embodiment of any of the foregoing methods, further comprising: additively manufacturing a second manifold for the heat exchanger, the method comprising: additively building a housing for the second manifold; within the housing for the second manifold, additively building a plurality of first guide vanes defining individual layers for the first medium; and additively building a plurality of second guide vanes dividing ones of the individual layers into a plurality of discrete second manifold flow passages.

A further embodiment of any of the foregoing methods, wherein the first guide vanes and the second guide vanes are sized, oriented, or spaced within the manifold to achieve a substantially uniform flow through the first manifold into the core.

A further embodiment of any of the foregoing methods, wherein the additive manufacturing step further comprises dividing the first manifold into a plurality of sub-units, each of which is independent from one another.

A further embodiment of any of the foregoing methods, wherein each of the plurality of sub-units receives a specified portion of the flow of the first medium.

A further embodiment of any of the foregoing methods, wherein a first sub-unit of the plurality of sub-units receives the first medium and at least one other sub-unit of the plurality of sub-units receives a second medium of the plurality of mediums.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A heat exchanger comprising:

a core configured to receive and place a plurality of mediums in at least one heat exchange relationship; and a first manifold connected to and in fluid communication with the core at a first manifold/core interface, the first manifold comprising:

a first end distal from the core with at least one port adapted to receive or discharge a first medium of the plurality of mediums;

a second end joined to the core at the first manifold/core interface adapted to transfer the first medium to or from a plurality of first heat exchange passages in the core;

a plurality of first guide vanes defining individual layers for the first medium; and a plurality of second guide vanes dividing ones of the individual layers into a plurality of first discrete manifold flow passages extending at least part of a distance from the first end to the second end of the first manifold;

wherein the plurality of first guide vanes are cantilevered from the first end of the first manifold and elastically deformable in response to flow of at least one medium through the plurality of individual layers.

2. The heat exchanger of claim 1, wherein the heat exchanger comprises a plate-and-fin heat exchanger or a micro-channel heat exchanger.

3. The heat exchanger of claim 1, wherein at least some of the individual layers or discrete flow passages in the manifold are in direct fluid communication with one or more of the first heat exchange passages in the core.

4. The heat exchanger of claim 1, wherein the core receives the first medium of the plurality of mediums flowing in a first direction and a second medium of the plurality of mediums flowing in a second direction at a nonzero angle relative to the first direction.

5. The heat exchanger of claim 1, further comprising:

a second manifold connected to and in fluid communication with the core at a second manifold/core interface, the second manifold comprising:

a first end distal from the core with at least one port adapted to receive or discharge a second medium of the plurality of mediums; and a second end joined to the core at the second manifold/core interface adapted to transfer the first medium to or from a plurality of second heat exchange passages in the core.

6. The heat exchanger of claim 5, wherein the second manifold further comprises a plurality of first guide vanes defining individual layers for the second medium, and a plurality of second guide vanes dividing ones of the individual layers into a plurality of second discrete manifold flow passages extending at least part of a distance from the first end to the second manifold/core interface.

7. The heat exchanger of claim 1, wherein the first manifold comprises a plurality of sub-units, each of which is independent from one another.

8. The heat exchanger of claim 7, wherein each of the plurality of sub-units receives a specified portion of the flow of the first medium.

9. The heat exchanger of claim 7, wherein a first sub-unit of the plurality of sub-units receives the first medium and at least one other sub-unit of the plurality of sub-units receives a second medium of the plurality of mediums.

10. A method of forming a heat exchanger core configured to receive and place a plurality of mediums in at least one heat exchange relationship, and a first manifold connected to and in fluid communication with the core at a first manifold/core interface, the first manifold comprising a first end distal from the core with at least one port adapted to receive or discharge a first medium of the plurality of mediums, and a second end joined to the core at the first manifold/core interface adapted to transfer the first medium to or from a plurality of first heat exchange passages in the core, the method comprising:

forming the heat exchanger core;

additively manufacturing the first manifold for the heat exchanger, the method comprising:

additively building a housing for the first manifold;

within the housing, additively building a plurality of first guide vanes defining individual layers for at least a first medium, wherein the plurality of first guide vanes are cantilevered from the first end of the first manifold and elastically deformable in response to flow of at least one medium through the plurality of individual layers, and additively building a plurality of second guide vanes dividing ones of the individual layers into a plurality of discrete first manifold flow passages extending at least part of a distance from the first end to the second end of the first manifold.

11. The method of claim 10, wherein the heat exchanger core comprises a plate and fin heat exchanger core or a micro-channel heat exchanger core.

12. The method of claim 10, further comprising aligning individual layers or discrete flow passages in the manifold such that at least some are in direct communication with one or more of the first heat exchange passages in the core.

13. The method of claim 10, wherein the core receives the first medium of the plurality of mediums flowing in a first direction and a second medium of the plurality of mediums flowing in a second direction at any angle relative to the first direction.

14. The method of claim 10, further comprising:

additively manufacturing a second manifold for the heat exchanger, the method comprising:

additively building a housing for the second manifold;

within the housing for the second manifold, additively building a plurality of first guide vanes defining individual layers for the first medium, wherein the plurality of first guide vanes are cantilevered from the first end of the first manifold and elastically deformable in response to flow of at least one medium through the plurality of individual layers; and additively building a plurality of second guide vanes dividing ones of the individual layers into a plurality of discrete second manifold flow passages extending at least part of a distance from the first end to the second end of the first manifold.

15. The method of claim 10, wherein the first guide vanes and the second guide vanes are sized, oriented, or spaced within the manifold to achieve a substantially uniform flow through the first manifold into the core.

16. The method of claim 10, wherein the additive manufacturing step further comprises dividing the first manifold into a plurality of sub-units, each of which is independent from one another.

17. The method of claim 16, wherein each of the plurality of sub-units receives a specified portion of the flow of the first medium.

18. The method of claim 16, wherein a first sub-unit of the plurality of sub-units receives the first medium and at least one other sub-unit of the plurality of sub-units receives a second medium of the plurality of mediums.

19. The method of claim 10, wherein at least one of the plurality of second guide vanes is perpendicular to at least one of the plurality of first guide vanes.

* * * * *